United States Patent [19]

Helberger et al.

[11] Patent Number: 4,979,555

[45] Date of Patent: Dec. 25, 1990

[54] ROLL CHANGE ASSEMBLY FOR A CONTINUOUS CASTER

[75] Inventors: Klaus Helberger; Mark R. Emaus; Carl I. Tucker, all of Valparaiso, Ind.

[73] Assignee: Bethlehem Steel Corporation, Bethlehem, Pa.

[21] Appl. No.: 350,539

[22] Filed: May 12, 1989

[51] Int. Cl.[5] ..... B22D 11/12; B21B 31/08

[52] U.S. Cl. ..... 164/442; 164/448; 72/239

[58] Field of Search ..... 164/442, 448; 72/239; 29/822; 198/339.1

[56] References Cited

U.S. PATENT DOCUMENTS

| | | | |
|---|---|---|---|
| 3,263,284 | 8/1966 | Okr et al. | 164/448 |
| 3,951,323 | 4/1976 | Libossort | 226/189 |
| 3,954,164 | 5/1976 | Bottomleg | 198/27 |
| 3,994,334 | 11/1976 | Schrewe | 164/282 |
| 4,012,825 | 3/1977 | Gränitz et al. | 29/427 |
| 4,581,819 | 4/1986 | Stangl | 29/822 |

*Primary Examiner*—Richard K. Seidel

*Assistant Examiner*—Rex E. Pelto

*Attorney, Agent, or Firm*—Shlesinger & Myers

[57] ABSTRACT

An apparatus for exchanging guide rollers in a continuous caster has a frame with two laterally spaced sides extending generally transverse to a support. First, second, third and fourth arms are provided, and the first and second arms are operably associated with a first one of the sides and extend in opposite directions and are pivotal about a first axis. Third and fourth arms are operably associated with the other of the sides and extend in opposite directions, and are pivotal about a second axis coaxial with the first axis. Roll engaging elements are associated with a second end portion of each arm, and the second end portion of each arm is remote from the associated axis. First and second double acting cylinder and piston assemblies are provided. Each of the cylinder and piston assemblies is associated with one of the sides, and the pistons of each cylinder and piston assembly are operably associated with the associated arms for causing pivoting thereof about the associated axis.

22 Claims, 4 Drawing Sheets

ROLL CHANGE ASSEMBLY FOR A CONTINUOUS CASTER

BACKGROUND OF THE INVENTION

A continuous caster is a steel processing system transforming molten steel into various usable forms, such as billets, without requiring the intermediate formation of ingots. In the course of transformation from molten steel to a solid billet, the steel passes through a containment system comprising a number of mutually vertically and horizontally spaced parallel rollers. At least some of the rollers are driven for advancing the steel through the system.

Those skilled in the art understand that the engagement of a roller with the steel, particularly when the steel is slightly below the solidification temperature, may result in the surface of the steel becoming marred by scratches, nicks and the like on the roller. The rollers must be replaced, as required, in order to minimize defects in the steel. The rollers are relatively large and heavy, and change is difficult and time consuming. Furthermore, the rollers are rotatable on vertically spaced parallel axes which are relatively close together, thereby further complicating replacement.

Those skilled in the art understand that there is a need for a containment system roll change assembly permitting the rollers to be quickly replaced, so that down time of the caster is minimized. The disclosed invention is just such a roll change assembly, and one which permits the rollers to be changed in a matter of minutes, rather than hours.

OBJECTS AND SUMMARY OF THE INVENTION

The primary object of the disclosed invention is an apparatus for exchanging the guide rollers of a continuous caster through the use of hydraulic motor assemblies comprising a cylinder and a piston, and the apparatus has a portable hydraulic power supply system for providing motive power to the cylinder and assemblies.

Yet a further object of the disclosed invention is a roll change assembly utilizing pivotal levers disposed exteriorly of the roll change frame for obtaining maximum benefit from the extension and retraction of the hydraulic motor assemblies.

An apparatus for exchanging guide rollers in a continuous caster comprises a frame having two laterally spaced sides extending generally transverse to a horizontal support. First, second, third and fourth arms are provided, with the first and second arms operably associated with a first one of the sides and extending in mutually opposite directions and being pivotal about a first axis associated with a first end portion of each arm. The third and fourth arms are operably associated with the other one of the sides, and they extend in mutually opposite directions and are pivotal about a second axis associated with a like first end portion of each arm and coaxial with the first axis. Roll engaging means are associated with a second end portion of each arm, and the second end portion of each arm is remote from the associated first end portion and axis. First and second double acting cylinder and piston assemblies are provided, with each of the cylinder and piston assemblies associated with one of the sides. The piston of each cylinder and piston assembly is operably associated with one of the arms for causing pivoting thereof about the associated axis.

An apparatus for exchanging guide rollers in a continuous caster comprises a frame having two laterally spaced parallel sides extending generally transverse to a horizontal support. First and second shafts are provided, with each shaft being secured to and extending exteriorly from one of the sides. The shafts are coaxial. First and second pair of arms are provided, with each arm having a sleeve at a first end portion thereof and a remote second end portion. Each sleeve is pivotally mounted to one of the shafts, so that the associated arm may pivot about the shaft. First and second drive means are provided, and each drive means has a first movable portion connected to one arm of a pair and a second movable portion connected to the other arm thereof. Roll engaging means are carried by each arm second portion, so that pivoting of an arm by the associated drive means permits a roll to be engaged by the roll engaging means.

A roll change system has a frame with laterally spaced sides. First and second pair of arms are provided, and each of the pairs is operably associated with one of the sides. The arms of each pair are pivotal about a common axis, and the axes are coaxial. Means are operably associated with each arm of a pair for causing pivoting thereof between an extend and a retract position. Roll engaging means are pivotally secured to and carried by each arm of a pair for selectively engaging and being disengaged from a roll.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings wherein.

DETAILED DESCRIPTION OF THE INVENTION

Figure 2:
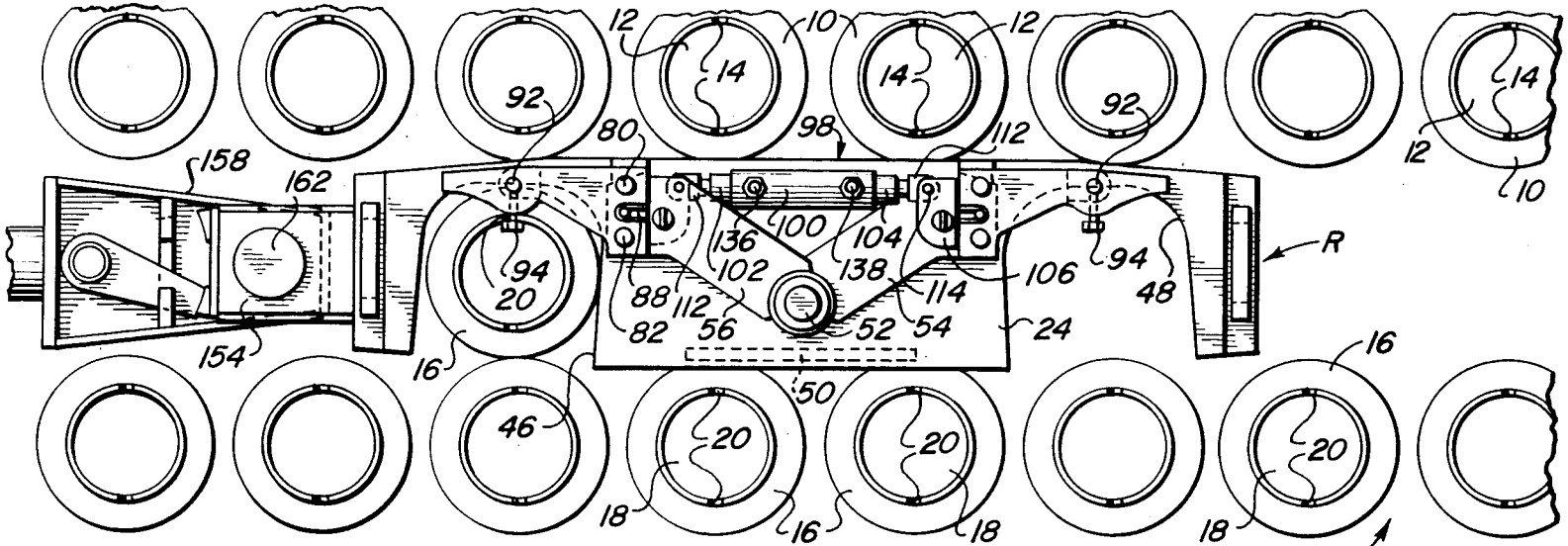
FIG. 2 is a side elevational view of the roll change assembly of FIG. 1 positioned in the containment system of a continuous caster in a first orientation.

Containment system C, as best shown in FIG. 2, comprises a first set of horizontally disposed rollers 10 rotatable on mutually parallel axes. Each of the rollers 10 has end portions 12 at the opposite ends thereof. Each end portion 12 has oppositely disposed slots 14. A second set of containment rollers 16 is vertically spaced from the first set of rollers 10. Each of the rollers 16 is likewise rotatable on mutually parallel axes, which axes are parallel to the axes of rotation of the rollers 10. As with the rollers 10, each roller 16 has oppositely disposed end portions 18. Each of the end portions 18 has two oppositely oriented slots 20 formed therein, and the slots 20 are identical with the slots 14.

Figure 1:
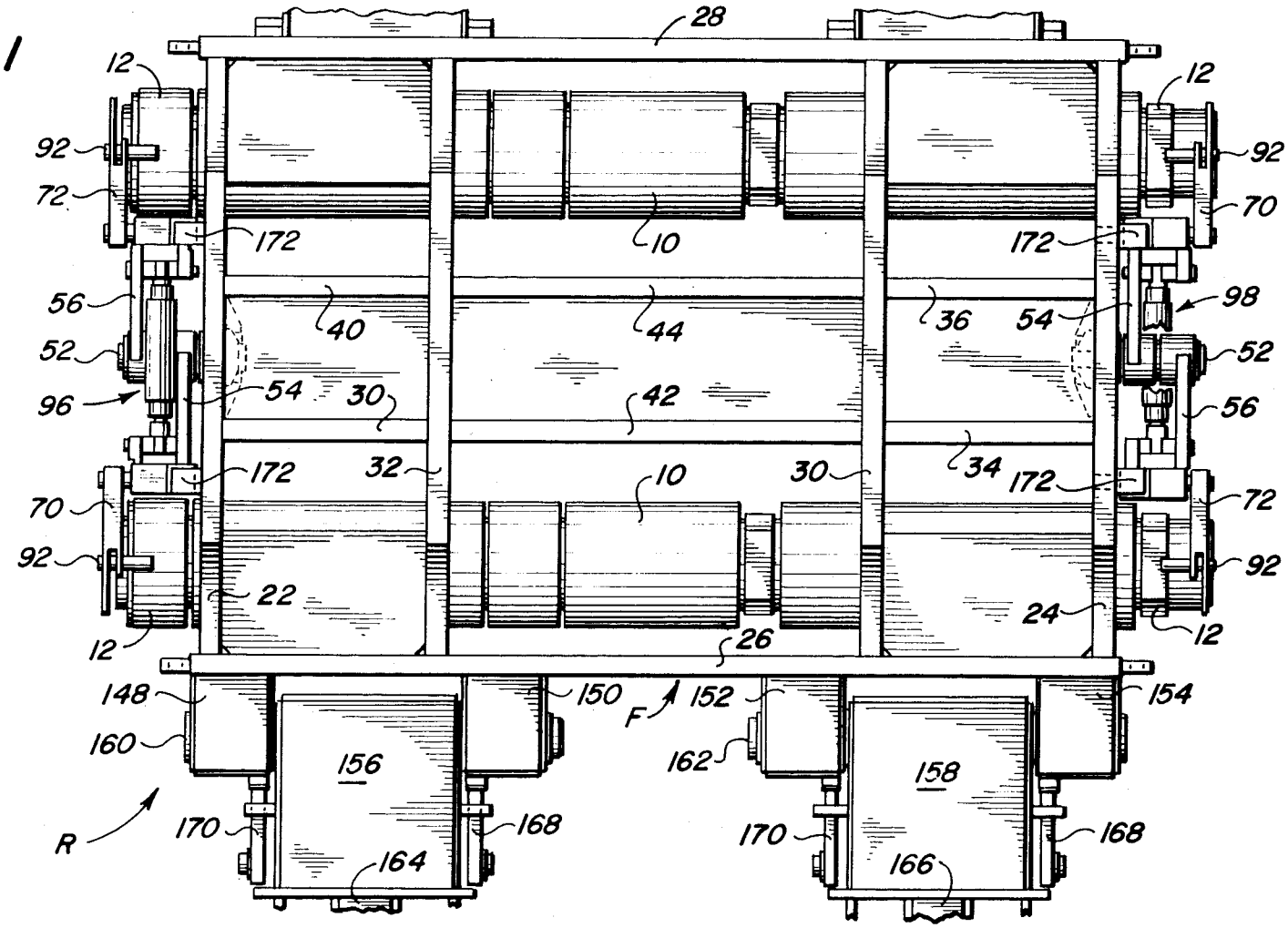
FIG. 1 is a fragmentary top plan view of a roll change assembly pursuant to the invention.
Figure 3:
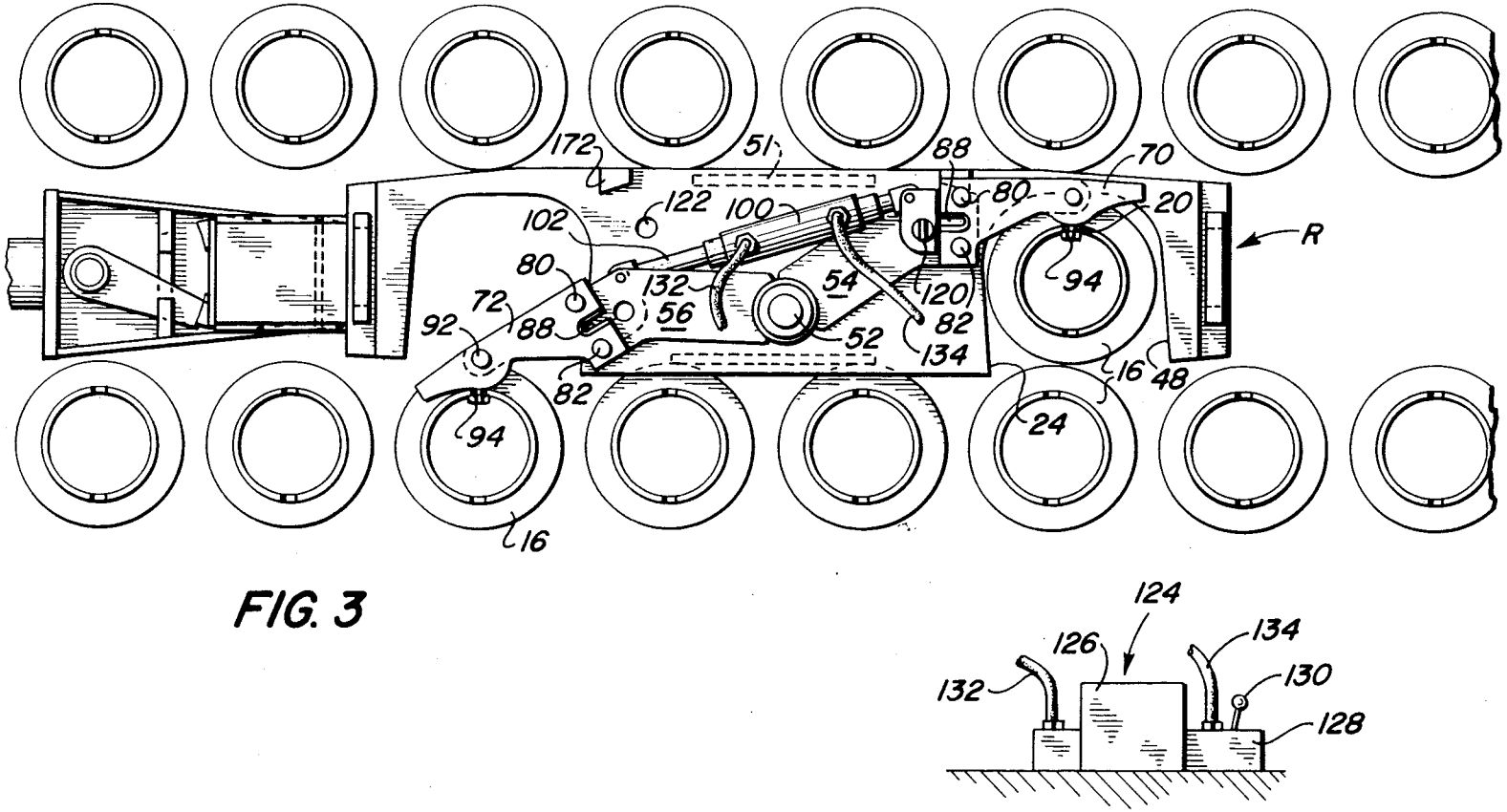
FIG. 3 is an elevational view similar to FIG. 2 with the arms disposed in a second orientation.

Roller change assembly R, as best shown in FIGS. 1–3, comprises a steel frame F having laterally spaced sides 22 and 24. The frame F has front and rear supports 26 and 28, respectively, and intermediate supports 30 and 32 extending therebetween parallel to the sides 22 and 24. Braces 34 and 36 interconnect support 30 with side 24, while braces 38 and 40 interconnect support 32 with side 22. Finally, braces 42 and 44 interconnect supports 30 and 32, and are aligned with the braces 34 and 38, respectively, and 36 and 40, respectively. In this way, the frame F is rigid, and yet has minimum weight.

Side 24, as best shown in FIG. 2, has U-shaped roller storage slots 46 and 48 at the opposite ends thereof. It can be noted in FIG. 1 that the sides 22 and 24 are disposed interiorly of the end portions 12 and 18 of the rollers 10 and 16. As a consequence thereof, a roller 10 or 16 may be lifted, as will be explained, into the slots 46 or 48 for being transported through the containment system C. The sides 24 and 22 each have a bottom horizontally disposed support 50 for providing rigidity. An upper support 51 is also provided for like reason, as best shown in FIG. 3.

Those skilled in the art will understand that the sides 22 and 24 have substantially identical lifting systems, and it is believed necessary only to provide a detailed discussion of the lifting assembly for side 24. The side 22, as shown in FIG. 1, has substantially the same parts which are operated in substantially the same way in cooperation therewith. The lifting system of the side 22 should cooperate with the lifting system of the side 24 in order to lift or lower a containment roller. Also, the roll change assembly R can be utilized for exchanging the rollers 10 and also the rollers 16, merely by reorientation of the roll change assembly R so that the slots 46 and 48 face upwardly or downwardly, as required.

Figure 4:
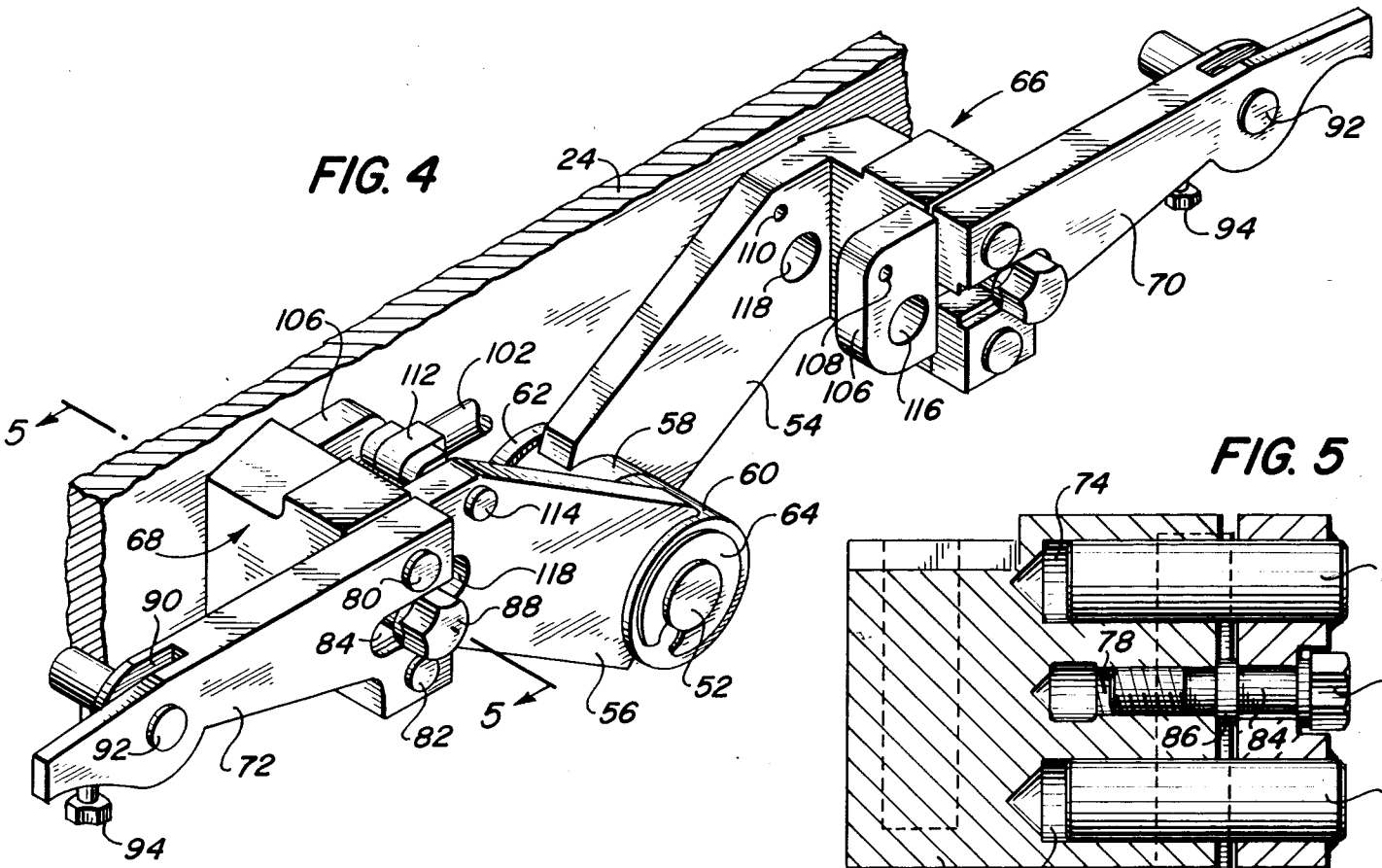
FIG. 4 is a fragmentary perspective view with portions broken away and eliminated for clarity in disclosing the pivoting arms of the system.

Side 24 has an axle or shaft 52 secured thereto and extendinq exteriorly therefrom, as best shown in FIG. 4. Arms 54 and 56 are pivotally secured thereto. Each of the arms 54 and 56 has a sleeve 58 and 60, respectively, at a first end portion thereof. The sleeves 58 and 60 have apertures therethrough permitting the associated sleeve to slide over the axle 52 and to be pivotal thereabout. A washer 62 is positioned between the side 24 and the inner surface of the sleeve 58 in order to permit free rotation of the arm 54 and to minimize wear. A clip ring or suitable securement mechanism 64 is secured exteriorly of sleeve 60 at the distal end of axle 52, in order to maintain the arms 54 and 56 mounted to the axle 52 and pivotal thereabout.

Each of the arms 54 and 56 has a remote second end portion 66 and 68, respectively. Shifting levers 70 and 72 are slideably secured to the second end portions 66 and 68, respectively. The shifting levers 70 and 72 are essentially identical, and only the shifting lever 72 will herein be further described in detail.

Figure 5:
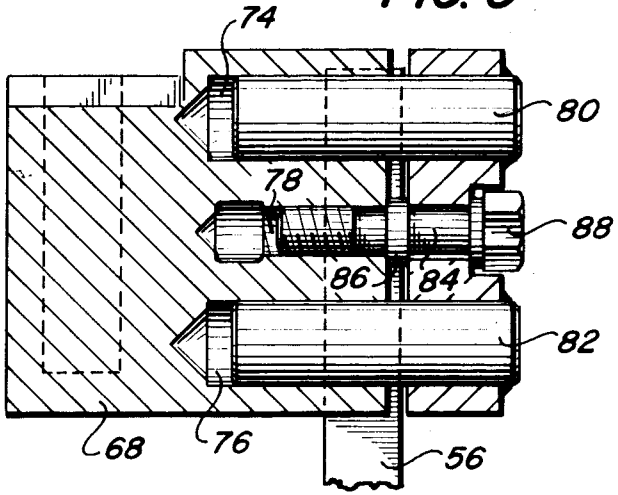
FIG. 5 is a cross-sectional view taken on the line 5—5 of FIG. 4 and viewed in the direction of the arrows; and, FIG. 6 is a perspective view of a locking pin used with the invention.

The end portion 68 of the arm 56 has vertically spaced horizontally disposed slots 74 and 76, as best shown in FIG. 5. Tapped aperture 78 is centrally disposed relative to the holes 74 and 76. Shifting lever 72 carries pins 80 and 82 which are slideably received within the holes 74 and 76, respectively. A U-shaped open ended slot 84 is formed in an end portion of the shifting lever 72 in alignment with tapped aperture 78. Shoulder 86 of bolt 88 is disposed between shifting lever 72 and end portion 68. The shoulder 86 prevents the shifting lever 72 from binding to the end portion 68, thereby facilitating longitudinal sliding of the pins 80 and 82 in the associated slots 74 and 76. Appropriate tightening of the bolt 88 thereby secures the shifting lever 72 relative to the arm 56, and likewise causes or permits sliding of the pins 80 and 82, and thereby shifting lever 72, along the axes thereof.

Slot 90 is formed in the remote end of shifting lever 72, as well as in the other shifting levers, and is oriented transversely to the axis of pin 92. Pin 92 is rotatably secured to shifting lever 72 and extends through the slot 90. T-bolt 94 has one end secured to the pin 92 in the slot 90 and has the T-end portion thereof extending therefrom for being positioned within one of the T-slots 14 and 20. The T-bolts 94 may therefore pivot relative to the shifting levers as the rollers are lifted and lowered.

Double acting cylinder and piston assemblies 96 and 98 are disposed exteriorly of side walls 22 and 24, respectively, for causing operation of the associated arms 54 and 56. The cylinder and piston assemblies 96 and 98 operate in a cooperating manner, so that the same arms 54 or 56 of the sides 22 and 24 are pivoted together. In this way, the selected roller 10 or 16 is displaced with its axis remaining parallel to the axes of the other rollers, in a manner minimizing strain on the side walls 22 and 24 and the associated lifting arms.

As best shown in FIG. 2, cylinder and piston assembly 98 has the cylinder 100 thereof positioned over the axle 52. The piston 102 thereof is pivotally secured to the arm 56, while the piston 104 thereof is likewise pivotally secured to the arm 54. It can be noted in FIG. 4 that bracket 106 is secured to end portion 66 and has an aperture 108 in alignment with the aperture 110 in the body portion of arm 54. A similar bracket 106 extends from end portion 68 of arm 56. The brackets 106 are spaced from the associated body portions in order to provide a slot in which clevis 112 may be received. The clevises 112 are pivotally secured to the end portion of each of the cylinders 102 and 104, and each receives a pin 114 for being pivotally secured to the associated arm.

Figure 6:
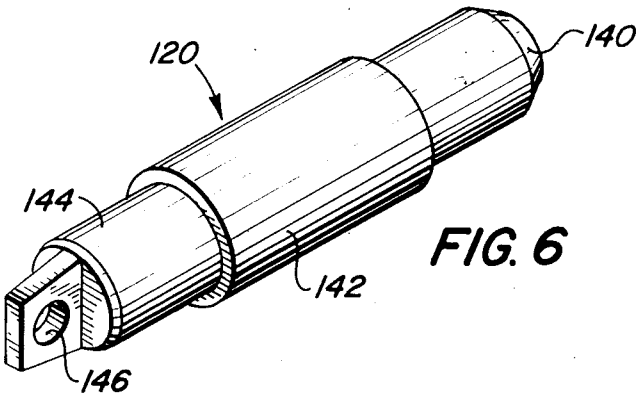

It can be noted in FIG. 4 that the bracket 106 has a further larger aperture 116 which is aligned with aperture 118 in the associated body portion of arm 54. Lock pin 120, as best shown in FIGS. 2 and 6, is positionable within the apertures 116 and 118. A corresponding aperture 122 is formed in each of the side walls 22 and 24, as best shown in FIG. 3, in alignment with the apertures 116 and 118 when the arms 54 and 56 are in the pivoted up position in order to receive a lock pin 120. Insertion of the lock pin 120 through the apertures 116, 118 and 122 locks the associated arm in the pivoted up position. Removal of the pin 120 from the associated aperture 122, on the other hand, permits the associated arm to pivot about its axle.

Portable hydraulic power supply 124 has a reservoir 126 and a motor driven pump 128. Control lever 130 is operably associated with valves carried by the power supply 124 for selectively directing pressurized hydraulic fluid through lines 132 and 134. The cylinder 100 of each of the cylinder and piston assemblies 96 and 98 has connections 136 and 138, as best shown in FIG. 2, which are selectively connectable with the lines 132 and 134, as best shown in FIG. 3. In this way, the operator (not shown) can appropriately direct pressurized hydraulic fluid to the cylinders 100 in order to cause selective extension and retraction of the pistons 102 and 104 and thereby pivoting of the arms 54 and 56. The non-pivoted one of the arms 54 and 56 is maintained locked in position by the lock pin 120, in order to make certain that only the selected one of the arms 54 and 56 is pivoted at any one time.

It can be noted in FIG. 6 that the lock pin 120 has an end portion 140 receivable within the aperture 122. The pin 120 also has a barrel portion 142 receivable in the aligned apertures 116 and 118. Finally, the pin 120 has an end portion 144, including an aperture 146 for facilitating displacement of the pin 120 as necessary.

Brackets 148 and 150 and 152 and 154 extend from front support 26, as best shown in FIG. 1. Corresponding brackets extend from rear support 28 for like reasons. Connection pieces 156 and 158 extend between the brackets 150 and 148 and 152 and 154, respectively, and are pivotal about pins 160 and 162, respectively. Connectors 164 and 166 extend from the connection pieces 156 and 158, respectively, and are securable to a dummy bar for causing the roll change assembly R to be transported through the containment system C. The connection pieces 156 and 158 are pivotal about the pins 160 and 162, respectively, because the containment system C need not be linearly disposed, and may have an arcuate path for guiding the steel. The roll change assembly R must be able to follow the path of the containment system C in order to permit the rollers to be exchanged.

Locking levers 168 and 170 are carried by each of the connection pieces 156 and 158 for locking the associated connectors 164 and 166 thereto.

Use of the roll change assembly R for installing or replacing one of the rollers 10 and 16 is relatively simple, because of the double acting cylinder and piston assemblies 96 and 98 and the portable power source 124 which may be disconnected in order to be moved as the assembly R is moved. FIG. 2 discloses the roll change assembly R transporting a roll 16 through the containment system C. The roll 16 has previously been removed from the containment system C, because the U-shaped storage slot 48 is empty, thereby indicating that a roll was placed in the containment system C and one removed.

FIG. 3 discloses the roll change assembly R as a roll 16 is being removed from the containment system C. Note that a replacement roll 16 is positioned within the U-shaped slots 48 ready for installation. It can be noted in FIG. 3 that the T-bolt 94 is angularly disposed relative to the orientation of the same T-bolt 94 in FIG. 2. This is because the T-bolts 94 pivot about the pin 92 in response to pivoting of the arms 54 and 56 about the axles 52. In FIG. 3, the pin 120 has secured the arms 54 in the pivoted up position, so that introduction of pressurized hydraulic fluid through the line 134 causes the pistons 102 to extend. After the roller 16 has been secured by the T-bolts 94, then the pressurized hydraulic fluid is directed through the line 132, thereby causing the piston 102 to retract. We provide stops 172 adjacent the slots 46 and 48 for limiting the upward pivoting of the arms 54 and 56. In this way, engagement with the stops 172 assures the operator that the pin 120 is aligned with the aperture 122, and that the associated arm is ready for being secured in the pivoted up position.

Those skilled in the art will understand that installation of a roller 10 or 16 into the containment system C is accomplished by extension of the pistons 102 or 104, as required, for causing pivoting of the arms 54 or 56, respectively. One of the rollers 10 or 16 is secured to the associated T-bolts 94 by movement longitudinally of the bolt 88 and is placed in its associated slot 48 for being transported through the containment system C. After the damaged roller 10 or 16 has been removed, then the roll change assembly R may be advanced through the containment system C until the roller to be installed is properly aligned. The lines 132 and 134 are sufficiently long to permit the displacement to occur without their needing to be disconnected. Extension of the associated pistons will cause pivoting of the arms. Once the roller 10 or 16 is installed, then the T-bolts 94 are removed from the T-slots 14 and 20, and the associated arm pivoted into the up position and the power source 124 disconnected.

While this invention has been described as having a preferred design, it is understood that it is capable of further modifications, uses and/or adaptations of the invention, following in general the principle of the invention, and falling within the scope of the invention and the limits of the claims appended hereto.

What we claim is:

1. Apparatus for exchanging guide rollers in a continuous caster, comprising:

(a) a frame having two laterally spaced sides extending generally transverse to a support;

(b) first, second, third and fourth arms, said first and second arms operably associated with a first one of said sides and extending in opposite directions and being pivotal about a first axis associated with a first end portion of each arm and said third and fourth arms operably associated with the other one of said sides and extending in opposite directions and being pivotal about a second axis associated with a first end portion of said third and fourth arms and coaxial with said first axis;

(c) roll engaging means associated with a second end portion of each arm, the second end portion of each arm being remote from the associated first end portion and associated axis;

(d) first and second double acting cylinder and piston means, each of said cylinder and piston means is associated with one of said sides and each piston of each cylinder and piston assembly is operably associated with an associated one of said arms for causing pivoting thereof about the associated axis; and (e) each of said roll engaging means being carried by the associated arm and pivotable relative thereto.

2. The apparatus of claim 1, wherein each roll engaging means includes:

(a) a pin carried by the arm and rotatable on an axis parallel to the associated first and second axes; and, (b) a bolt secured to said pin and extending therefrom and engageable with the roller.

3. The apparatus of claim 1, wherein:

(a) means are operably associatable with each of said arms and with said frame for locking same arms in a selected position.

4. The apparatus of claim 3, wherein:

(a) power supply means are selectively connectable with said cylinder and piston means for supplying pressurized fluid thereto, so that application of pressurized fluid to said cylinder and piston means causes one of the pistons thereof to extend when the associated arms are not locked and the other arms are locked.

5. The apparatus of claim 1, wherein each arm includes:

(a) a body having a first end element proximate the associated axis and a remote second end element; and, (b) a shifting lever has a first end element operably associated with the associated body second end element and a remote second end element carrying said roll engaging means.

6. The apparatus of claim 5, wherein:

(a) means are operably associated with each shifting lever first end element and the associated body second end element for permitting movement of each shifting lever relative to the associated body.

7. The apparatus of claim 6, wherein each permitting means includes:

(a) first and second aligned, spaced, parallel openings disposed in the body second end element;

(b) first and second pins carried by and extending from the shifting lever first end element, each pin received within one of the slots;

(c) a slot disposed in the shifting lever first end element between the associated pins and parallel to the associated first and second openings; and, (d) lock means received within the associated slot and securable in the associated body second end element for locking the shifting lever relative to the body.

8. The apparatus of claim 7, wherein:

(a) the slot of each arm is open at an end thereof.

9. The apparatus of claim 1, further comprising:

(a) first and second shafts, each shaft extends from one of said sides and said shafts are coaxial; and, (b) each arm first end portion includes a sleeve, and each sleeve is pivotally mounted to one of said shafts.

10. The apparatus of claim 1, wherein:

(a) said frame has a front wall extending from said support generally transverse thereto and to said sides;

(b) first, second, third and fourth members extend from said front wall, said members disposed in pairs and each pair associated with one of said sides; and, (c) first and second connection pieces, each connection piece received between and pivotal relative to the associated member pair.

11. The apparatus of claim 1, wherein:

(a) said arms and said cylinder piston means are exteriorly disposed relative to the associated sides.

12. Apparatus for exchanging guide rollers in a continuous caster, comprising:

(a) a frame having two laterally spaced parallel sides extending generally transverse to a support;

(b) first and second shafts, each shaft secured to and extending exteriorly from one of said sides and said shafts are coaxial;

(c) first and second pair of arms, each arm having a sleeve at a first end portion thereof and a remote second end portion and each sleeve is pivotally mounted to one of said shafts so that the associated arm may pivot about the shaft;

(d) first and second drive means, each drive means has a first movable portion connected to one arm of a pair and a second movable portion connected to the other arm of a pair;

(e) roll engaging means carried by each arm second portion, so that pivoting of an arm by the associated drive means permits a roller to be engaged by said roll engaging means; and (f) each of said roll engaging means being pivotable relative to the associated arm second portion.

13. The apparatus of claim 12, wherein each arm includes:

(a) a body with a sleeve at one end thereof and a remote second end; and, (b) a shifting lever has first and second ends and the first end is secured to the associated body second end, and said roll engaging means are secured to each associated shifting lever intermediate the shifting lever first and second ends.

14. The apparatus of claim 13, wherein:

(a) means are operably associated with each body second end and the associated shifting lever first end for permitting movement of the shifting lever relative to the body.

15. The apparatus of claim 13, wherein:

(a) means removably secure each shifting lever to the associated body.

16. The apparatus of claim 12 wherein:

(a) lock means are operably associated with each of said arms and are selectively engageable with said frame for locking said arms in a selected position.

17. The apparatus of claim 16, wherein:

(a) each lock means comprises a pin carried by the associated arm, and each pin is positionable in an associated aperture in said frame.

18. The apparatus of claim 12, wherein:

(a) each of said motor means is a double acting hydraulic cylinder and piston assembly, and each piston thereof is operably secured to one of said arms.

19. The apparatus of claim 18, further comprising:

(a) portable power supply means for supplying pressurized hydraulic fluid; and, (b) means operably associated with said power supply means and selectively connectable with said cylinder and piston assemblies for supplying pressurized hydraulic fluid thereto for causing extension and retraction of the pistons thereof and thereby pivoting of said arms.

20. A roll change system, comprising:

(a) a frame having laterally spaced sides;

(b) first and second pair of arms, each of said pairs operably associated with one of said sides and the arms of each pair are pivotal about a common axis and the axes of said pairs are coaxial;

(c) means operably associated with each arm of a pair for causing pivoting thereof between an extend and a retract position;

(d) roll engaging means pivotally secured to and carried by each arm of a pair for selectively engaging and being disengaged from a roll; and (e) each of said roll engaging means being pivotable relative to the associated arm.

21. Apparatus for exchanging guide rollers in a continuous caster, comprising:

(a) a frame having two laterally spaced sides extending generally transverse to a support;

(b) first, second, third and fourth arms, said first and second arms operably associated with a first one of said sides and extending in opposite directions and being pivotal about a first axis associated with a first end portion of each arm and said third and fourth arms operably associated with the other one of said sides and extending in opposite directions and being pivotal about a second axis associated with a first end portion of said third and fourth arms and coaxial with said first axis;

(c) roll engaging means associated with a second end portion of each arm, the second end portion of each arm being remote from the associated first end portion and associated axis;

(d) first and second double acting cylinder and piston means, each of said cylinder and piston means is associated with one of said sides and each piston of each cylinder and piston assembly is operably associated with an associated one of said arms for causing pivoting thereof about the associated axis;

(e) each of said arms including a body having a first end element proximate the associated axis and a remote second end element, and a shifting lever having a first end element operably associated with the associated body second end element and a remote second element carrying said roll engaging means;

(f) means operably associated with each shifting lever first end element and the associated body second end element for permitting movement of each shifting lever relative to the associated body;

(g) first and second aligned, spaced, parallel openings disposed in the body second end element;

(h) first and second pins carried by and extending from the shifting lever first end element, each pin received within one of the slots;

(i) a slot disposed in the shifting lever first end element between the associated pins and parallel to the associated first and second openings; and (j) lock means received within the associated slot and securable in the associated body second end element for locking the shifting lever relative to the body.

22. Apparatus for exchanging guide rollers in a continuous caster, comprising:

(a) a frame having two laterally spaced parallel sides extending generally transverse to a support;

(b) first and second shafts, each shaft secured to and extending exteriorly from one of said sides and said shafts are coaxial;

(c) first and second pair of arms, each arm having a sleeve at a first end portion thereof and a remote second end portion and each sleeve is pivotally mounted to one of said shafts so that the associated arm may pivot about the shaft;

(d) first and second drive means, each drive means has a first movable portion connected to one arm of a pair and a second movable portion connected to the other arm of a pair;

(e) roll engaging means carried by each arm second portion, so that pivoting of an arm by the associated drive means permits a roller to be engaged by said roll engaging means;

(f) lock means operably associated with each of said arms and selectively engageable with said frame for locking said arms in a selected position; and (g) each lock means comprising a pin carried by the associated arm, and each pin being positionable in an associated aperture in said frame.

* * * * *